US011808255B2

(12) United States Patent
Chuang

(10) Patent No.: US 11,808,255 B2
(45) Date of Patent: Nov. 7, 2023

(54) FLOOR PUMP

(71) Applicant: Louis Chuang, Taichung (TW)

(72) Inventor: Louis Chuang, Taichung (TW)

( * ) Notice: Subject to any disclaimer, the term of this patent is extended or adjusted under 35 U.S.C. 154(b) by 15 days.

(21) Appl. No.: 17/874,516

(22) Filed: Jul. 27, 2022

(65) Prior Publication Data

US 2023/0160377 A1 May 25, 2023

(30) Foreign Application Priority Data

Nov. 24, 2021 (TW) ..... 110143857

(51) Int. Cl.
*F04B 33/00* (2006.01)
*F04B 39/14* (2006.01)

(52) U.S. Cl.
CPC ..... *F04B 33/00* (2013.01); *F04B 39/14* (2013.01)

(58) Field of Classification Search
CPC ..... F04B 33/00; F04B 39/14; F16M 11/242; F16M 11/32; F16M 11/38
USPC ..... 417/423.14, 423.15; 248/170, 166, 165, 248/168, 173, 188
See application file for complete search history.

(56) References Cited

U.S. PATENT DOCUMENTS 6,173,928 B1 1/2001 Coats

FOREIGN PATENT DOCUMENTS

| | | | |
|---|---|---|---|
| CN | 104276230 | A | 1/2015 |
| TW | 409785 | U | 10/2000 |
| TW | 200613183 | A | 5/2006 |
| TW | M586749 | U | 11/2019 |

*Primary Examiner* — Kenneth J Hansen
*Assistant Examiner* — Benjamin Doyle
(74) *Attorney, Agent, or Firm* — Karin L. Williams; Alan D. Kamrath; Mayer & Williams PC

(57) ABSTRACT

A floor pump includes a main body and a supporting device. The supporting device includes a base and a first leg. The base is fixed to the main body and has a first stopping flange and a second stopping flange. The first leg is pivotally connected to the base to approach or move away from the base. The first leg has a front end and a rear end. When the first leg is approached to the base, the first leg is limited by the first and second stopping flanges to a folded position or an unfolded position. When the first leg is in the folded position, the front end is approached to the main body. When the first leg is in the unfolded position, the front end is distal away from the main body.

13 Claims, 20 Drawing Sheets

FLOOR PUMP

BACKGROUND

The present invention relates to a floor pump and, more particular, to a floor pump with legs.

Taiwan Patent No. TW409785U discloses an inflation pump auxiliary positioning device. It is mainly provided with a positioning device and a receiving portion formed in a middle of the positioning device for sleeving on an outer edge wall of a pump body, and symmetrical flanges are arranged on both sides of the positioning device. Outer periphery walls of the flanges has notch grooves, and a sleeve with an elastic member is placed inside the flange. In addition, one end of a support frame forms symmetrical contact surfaces, and the other end has a concave edge groove. One side inner wall of the concave edge groove is protruded with an engaging block, and an extension rod is arranged inside. The concave edge groove is correspondingly covered on the flange of the positioning device, so that the engaging block in the concave edge groove is fastened to the notch grooves of the flange, and the flanges on both sides of the positioning device are accommodated and sleeved by the sleeve with the elastic member, so that the extension rod in the concave edge groove is connected with the sleeve.

However, when the positioning device is unfolded or folded, the engaging block must be precisely aligned and engaged into the notch groove to achieve the positioning effect. Not only is the operation lacking in convenience, but also the supporting force generated by the engaging cooperation between the notch groove and the engaging block is insufficient, and if the load is too large, the positioning device may be damaged.

Thus, a need exists for a novel floor pump to mitigate and/or obviate the above disadvantages.

SUMMARY

An objective of the present invention is to provide a floor pump including a main body and a supporting device. The supporting device includes a base and a first leg. The base is fixed to the main body and has a first stopping flange and a second stopping flange. The first leg is pivotally connected to the base and rotatable relative to the base about a first rotation axis, and the first leg is axially movable along the first rotation axis to approach or move away from the base. The first leg has a front end and a rear end. The first leg forms a front section between the front end and the first rotation axis, and the first leg forms a rear section between the rear end and the first rotation axis. The first leg has a first side and a second side opposite to the first side on an outer periphery thereof along a radial direction of the first rotation axis. When the first leg is moved away from the base, the first leg is rotatable relative to the base. When the first leg is approached to the base, the first leg is limited to a folded position or an unfolded position. When the first leg is in the folded position, one side of the front section adjacent to the first side is close to the first stopping flange, and one side of the rear section adjacent to the second side is close to the second stopping flange, and the front end is approached to the main body. When the first leg is in the unfolded position, one side of the front section adjacent to the second side is close to the first stopping flange, and one side of the rear section adjacent to the first side is close to the second stopping flange, and the front end is distal away from the main body.

In an embodiment, the base is connected to an axial rod having an outer periphery sleeved by an axial sleeve. The first leg has a pivot hole along an axial direction of the first rotation axis. The floor pump further includes a pivot mechanism. The pivot mechanism includes a biasing member, a cover sleeve, and a pull collar. The biasing member sleeves on the axial sleeve. The cover sleeve inserts into the pivot hole and sleeves on the biasing member. One end of the biasing member along the axial direction of the first rotation axis abuts against the axial sleeve and another end of the biasing member abuts against the cover sleeve, and the pull collar is connected to the cover sleeve and located at one side of the first leg opposite to the base.

In an embodiment, the side of the first leg opposite to the base has an engaging recess disposed adjacent to the pivot hole. One side of the pull collar adjacent to the first leg has an engaging flange engaged with the engaging recess. The first leg and the pull collar is axially movable along the first rotation axis synchronously. When the first leg is moved away from the base, the first leg and the pull collar is rotatable relative to each other synchronously.

In an embodiment, the base further has a third stopping flange and a fourth stopping flange. The third stopping flange and the first stopping flange are respectively disposed on opposite sides of the base and form a symmetrical structure. The fourth stopping flange and the second stopping flange are respectively disposed on opposite sides of the base and form a symmetrical structure. The supporting device further includes a second leg. The second leg is pivotally connected to the base and rotatable relative to the base about a second rotation axis, and the second leg is axially movable along the second rotation axis to approach or move away from the base, When the second leg is moved away from the base, the second leg is rotatable relative to the base. When the second leg is approached to the base, the second leg is limited, and the second leg and the first leg are respectively arranged on two opposite sides of the base and form a symmetrical structure.

In an embodiment, the base has a first limiting flange, When the first leg is in the folded position, the first leg is limited between the first stopping flange and the first limiting flange, When the first leg is in the unfolded position, the first leg is limited between the first limiting flange and the second stopping flange.

In an embodiment, the base further has a third stopping flange, a fourth stopping flange, and a second limiting flange. The third stopping flange and the first stopping flange are respectively arranged on two opposite sides of the base and form a symmetrical structure. The fourth stopping flange and the second stopping flange are respectively arranged on the two opposite sides of the base and form a symmetrical structure. The second limiting flange and the first limiting flange are respectively arranged on the two opposite sides of the base and form a symmetrical structure. The supporting device further includes a second leg. The second leg is pivotally connected to the base and rotatable relative to the base about a second rotation axis, and the second leg is axially movable along the second rotation axis to approach or move away from the base, When the second leg is moved away from the base, the second leg is rotatable relative to the base. When the second leg is approached to the base, the second leg is limited, and the second leg and the first leg are respectively arranged on the two opposite sides of the base and form a symmetrical structure.

In an embodiment, the main body has a footrest. The footrest has a connection flange extending in a vertical direction. An outer periphery of the connection flange has a T-shaped cross section in a horizontal direction. The base has a connection groove and is movable in the vertical direction to cause the connection groove to sleeve on the connection flange. An inner periphery of the connection groove has a T-shaped cross section in the horizontal direction.

Another objective of the present invention is to provide a floor pump including a main body and a supporting device. The supporting device includes a base and a first leg. The base is fixed to the main body and has a first stopping flange and a second stopping flange. The first leg is pivotally connected to the base and rotatable relative to the base about a first rotation axis, and the first leg is axially movable along the first rotation axis to approach or move away from the base. The first leg has a front end and a rear end. The first leg forms a front section between the front end and the first rotation axis, and the first leg forms a rear section between the rear end and the first rotation axis. The first leg has a first side and a second side opposite to the first side on an outer periphery thereof along a radial direction of the first rotation axis. One side of the first leg adjacent to the base has an engaging groove. When the first leg is moved away from the base, the first leg is rotatable relative to the base. When the first leg is approached to the base, the first leg is limited to a folded position or an unfolded position. When the first leg is in the folded position, the first side is close to the first stopping flange, and one side of the rear section adjacent to the second side is close to the second stopping flange, and the front end is approached to the main body. When the first leg is in the unfolded position, the engaging groove sleeves on the first stopping flange, and one side of the rear section adjacent to the first side is close to the second stopping flange, and the front end is distal away from the main body.

In an embodiment, the base is connected to an axial rod having an outer periphery sleeved by an axial sleeve. The first leg has a pivot hole along an axial direction of the first rotation axis. The floor pump further includes a pivot mechanism. The pivot mechanism includes a biasing member, a cover sleeve, and a pull collar. The biasing member sleeves on the axial sleeve. The cover sleeve inserts into the pivot hole and sleeves on the biasing member. One end of the biasing member along the axial direction of the first rotation axis abuts against the axial sleeve and another end of the biasing member abuts against the cover sleeve. The pull collar is connected to the cover sleeve and located at one side of the first leg opposite to the base.

In an embodiment, the side of the first leg opposite to the base has an engaging recess disposed adjacent to the pivot hole. One side of the pull collar adjacent to the first leg has an engaging flange engaged with the engaging recess. The first leg and the pull collar is axially movable along the first rotation axis synchronously. When the first leg is moved away from the base, the first leg and the pull collar is rotatable relative to each other synchronously.

In an embodiment, the base further has a positioning flange disposed adjacent to the axial rod. One side of the cover sleeve adjacent to the base has a first positioning recess and a second positioning recess When the first leg is in the folded position, the positioning flange is engaged in the first positioning recess. When the first leg is in the unfolded position, the positioning flange is engaged in the second positioning recess.

In an embodiment, the base further has a third stopping flange and a fourth stopping flange. The third stopping flange and the first stopping flange are respectively arranged on two opposite sides of the base and form a symmetrical structure. The fourth stopping flange and the second stopping flange are respectively arranged on the two opposite sides of the base and form a symmetrical structure. The supporting device further includes a second leg. The second leg is pivotally connected to the base and rotatable relative to the base about a second rotation axis, and the second leg is axially movable along the second rotation axis to approach or move away from the base, When the second leg is moved away from the base, the second leg is rotatable relative to the base. When the second leg is approached to the base, the second leg is limited, and the second leg and the first leg are respectively arranged on the two opposite sides of the base and form a symmetrical structure.

In an embodiment, the main body has a footrest. The footrest has a connection flange extending in a vertical direction. An outer periphery of the connection flange has a T-shaped cross section in a horizontal direction. The base has a connection groove and is movable in the vertical direction to cause the connection groove to sleeve on the connection flange. An inner periphery of the connection groove has a T-shaped cross section in the horizontal direction.

The present invention will become clearer in light of the following detailed description of illustrative embodiments of this invention described in connection with the drawings.

DETAILED DESCRIPTION

Figure 1:
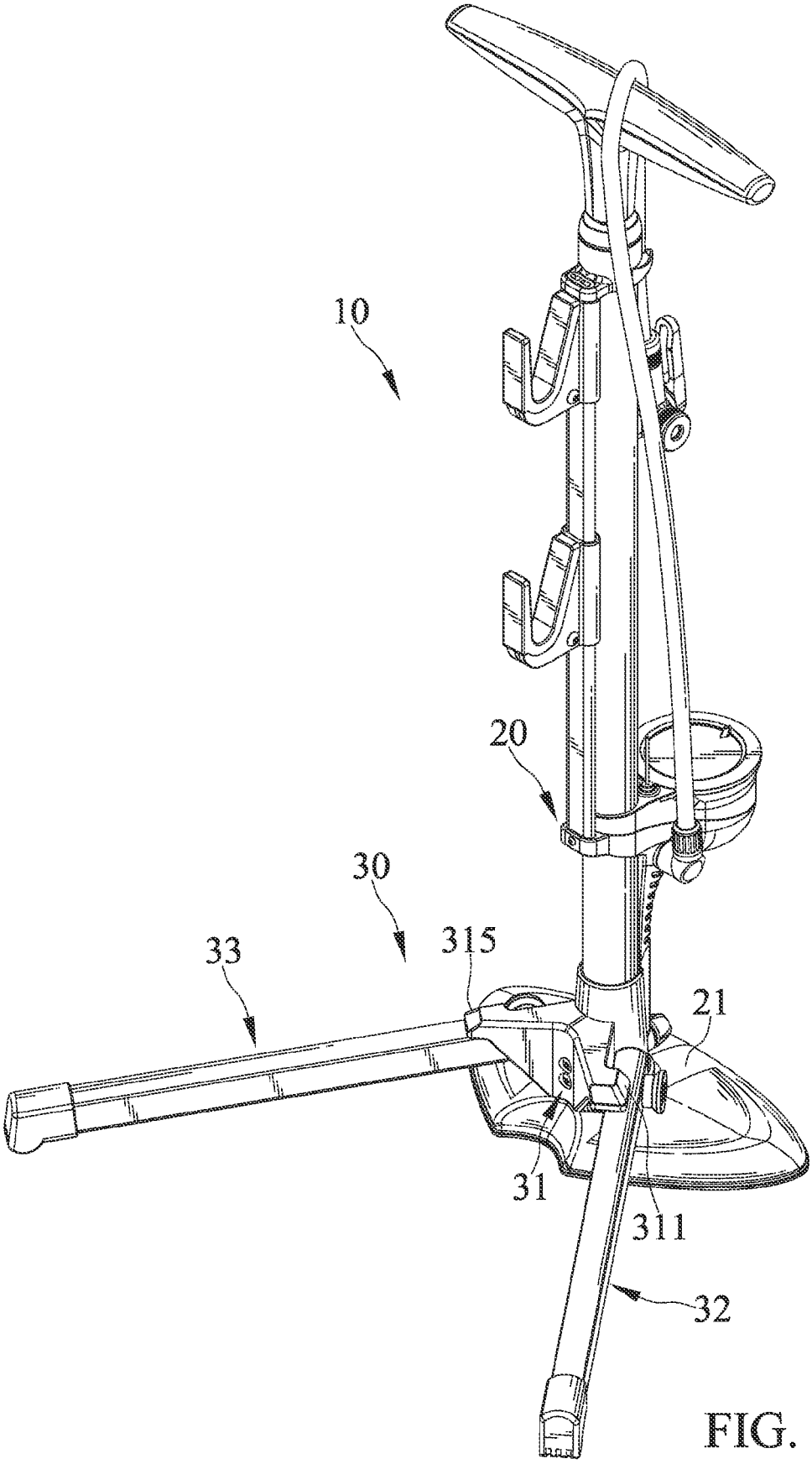
FIG. 1 is a perspective view of a floor pump of a first embodiment according to the present invention and shows legs arranged in an unfolded position.
Figure 2:
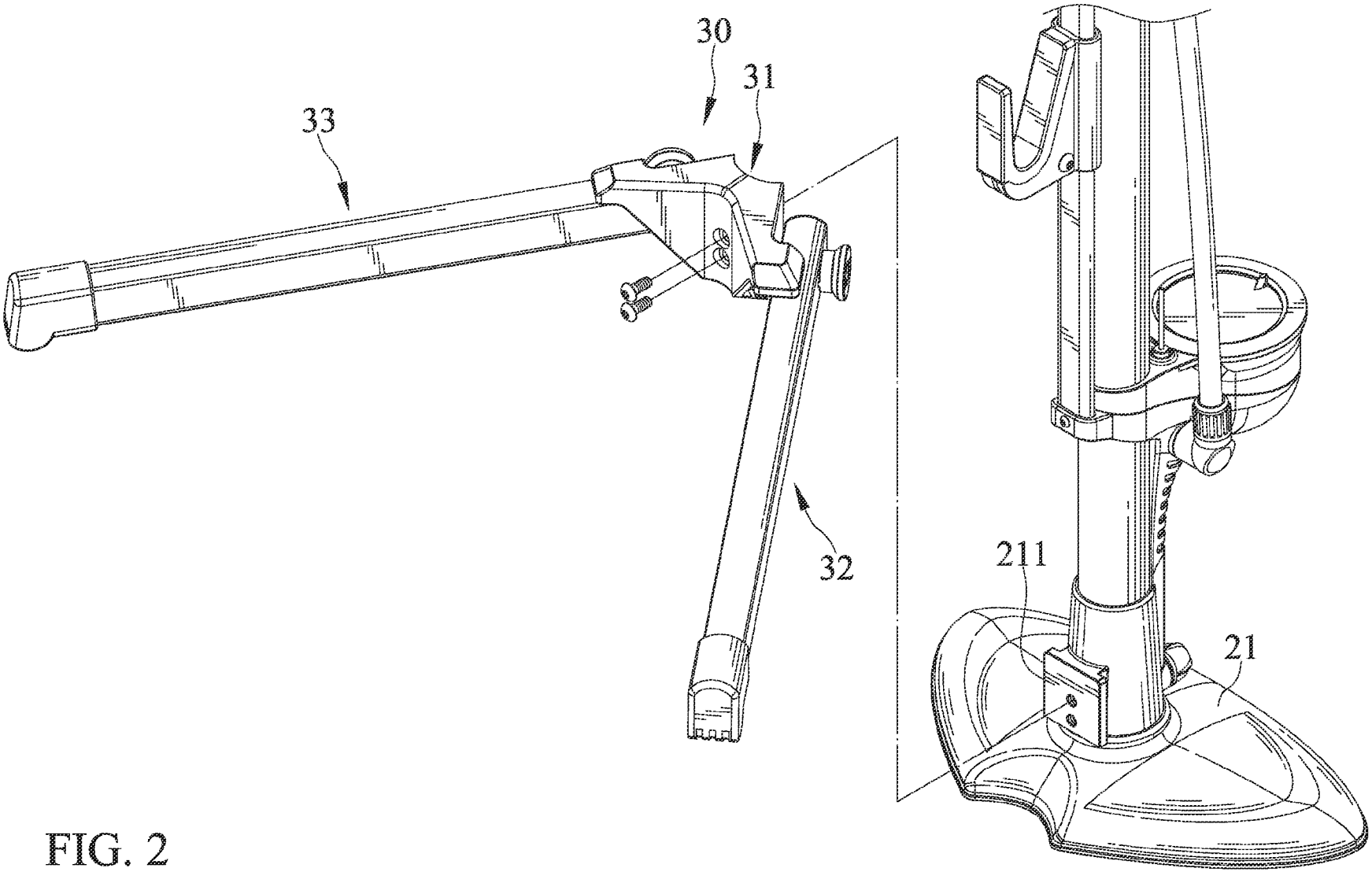
FIG. 2 is an exploded, perspective view of the floor pump of FIG. 1.
Figure 3:
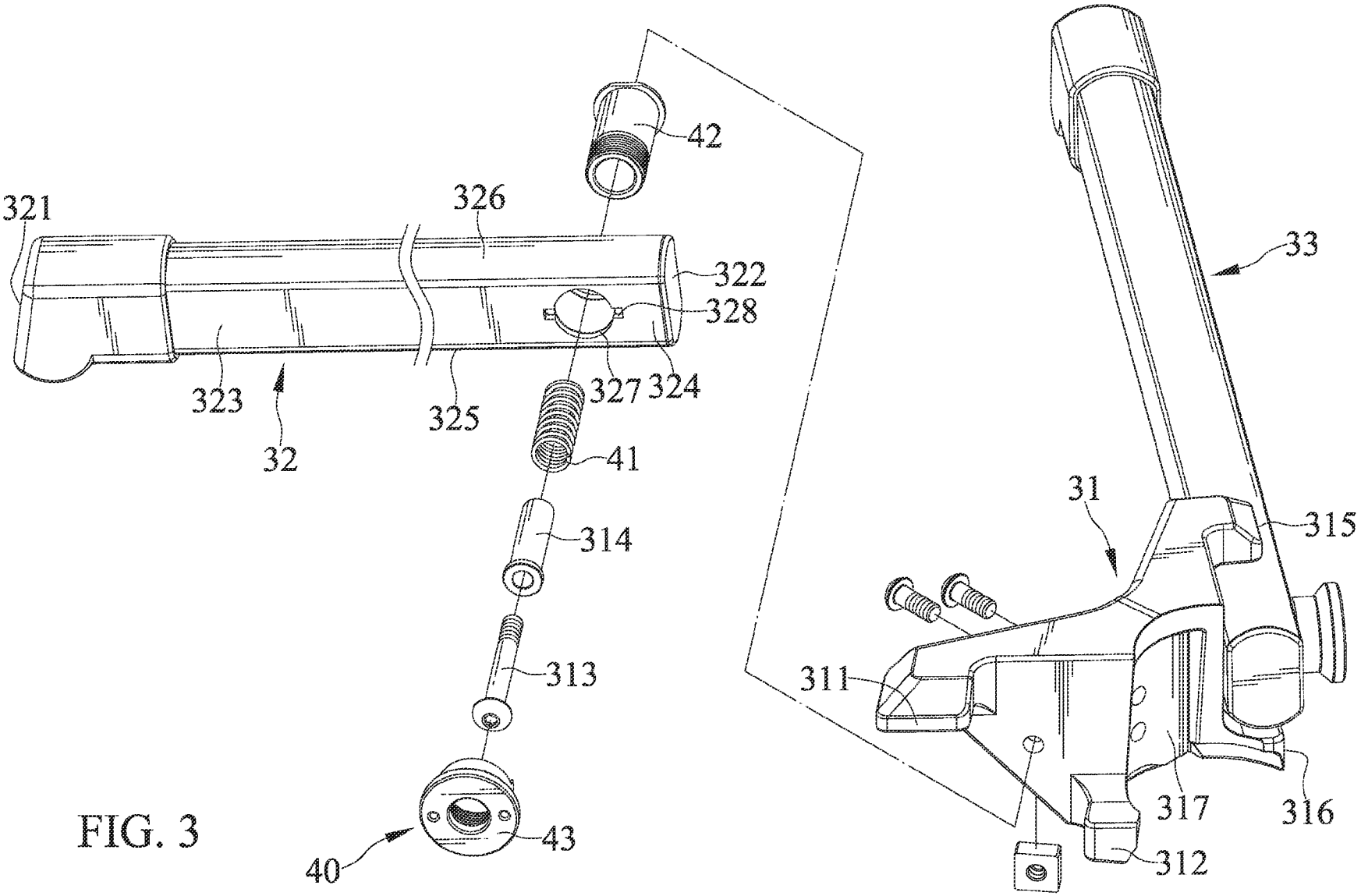
FIG. 3 is an exploded, perspective view of a supporting device of the floor pump of FIG. 1.
Figure 4:
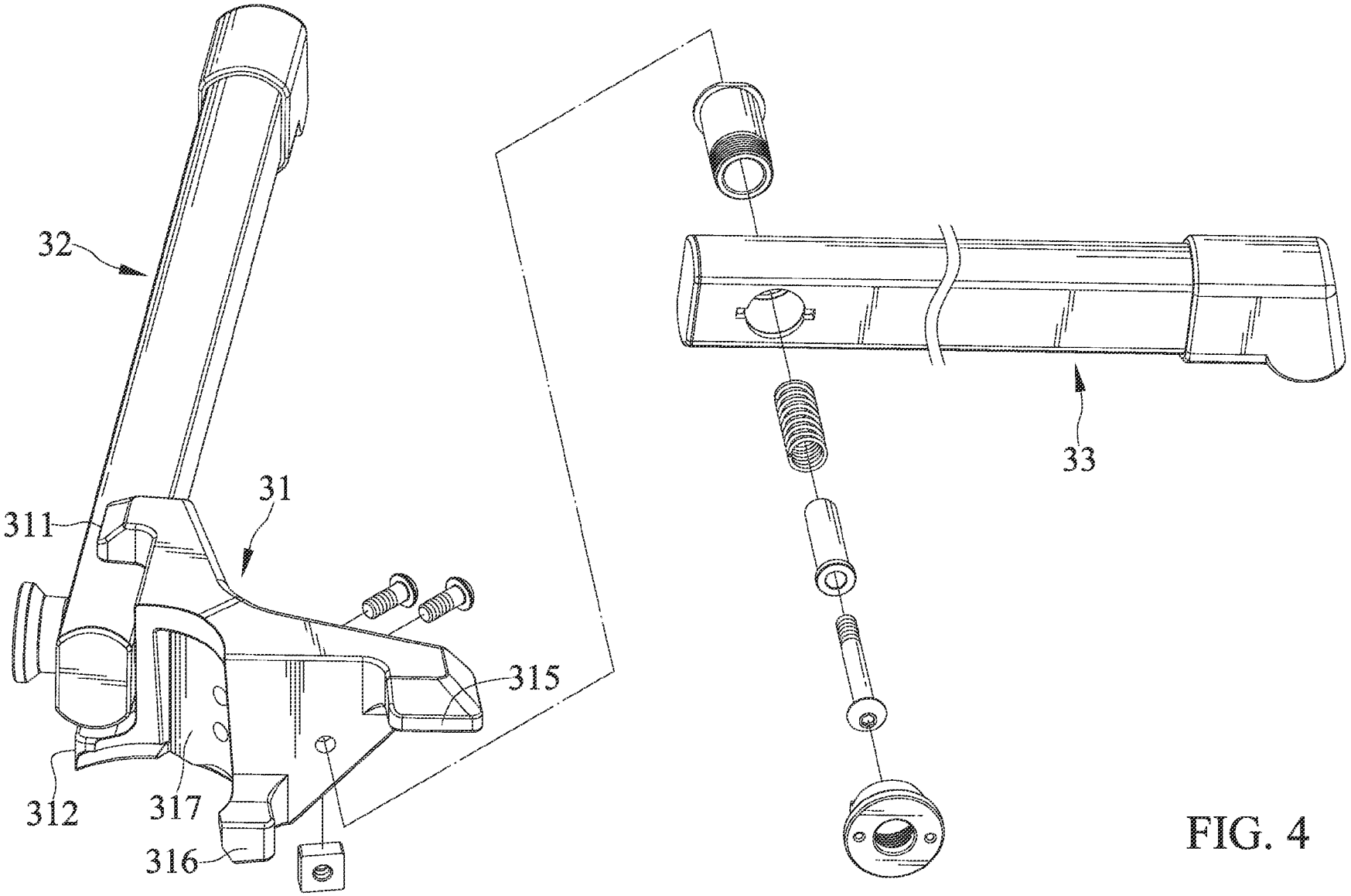
FIG. 4 is another exploded, perspective view of the supporting device of the floor pump of FIG. 1.
Figure 5:
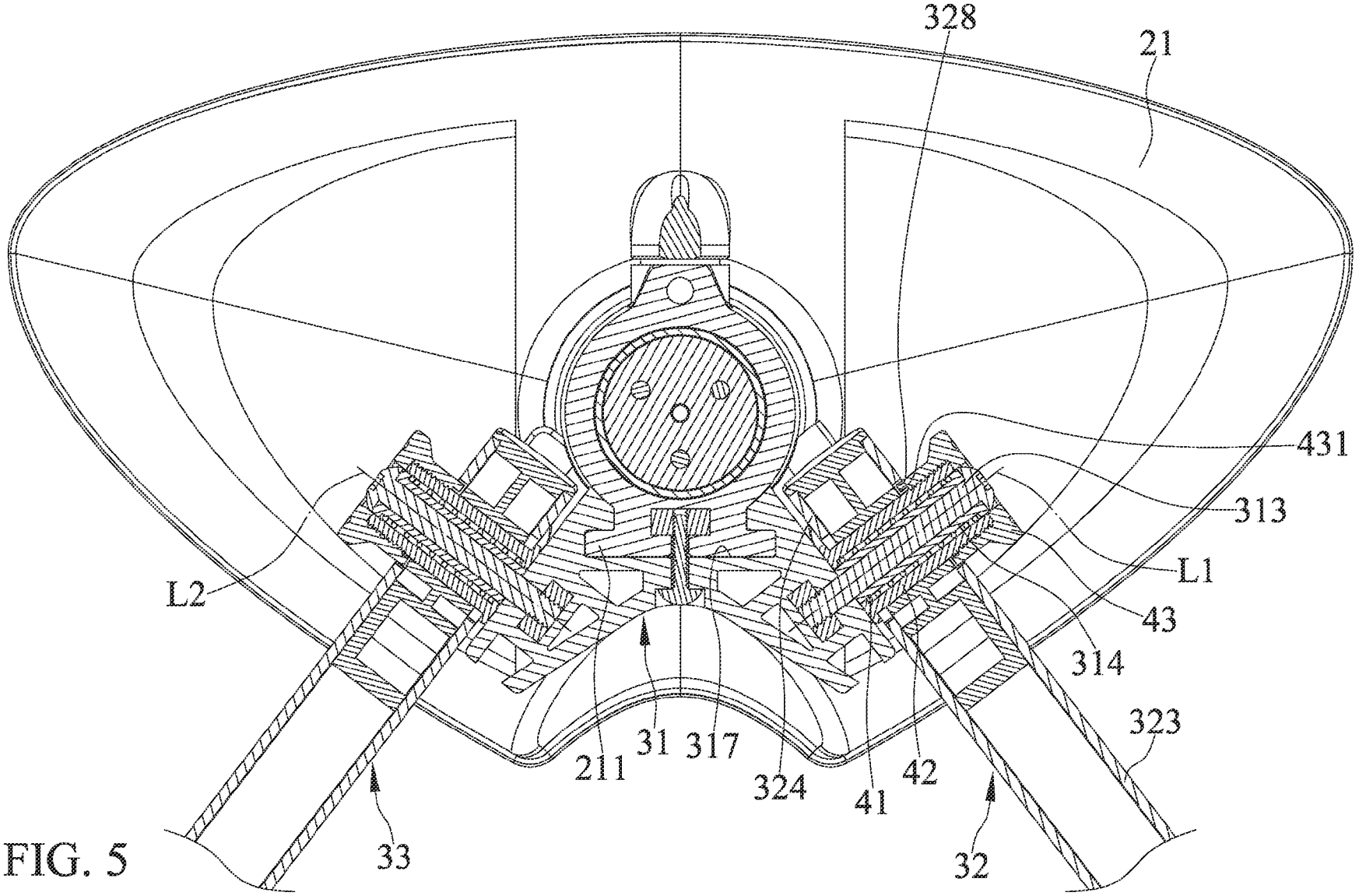
FIG. 5 is a cross sectional view of the floor pump of FIG. 1.
Figure 6:
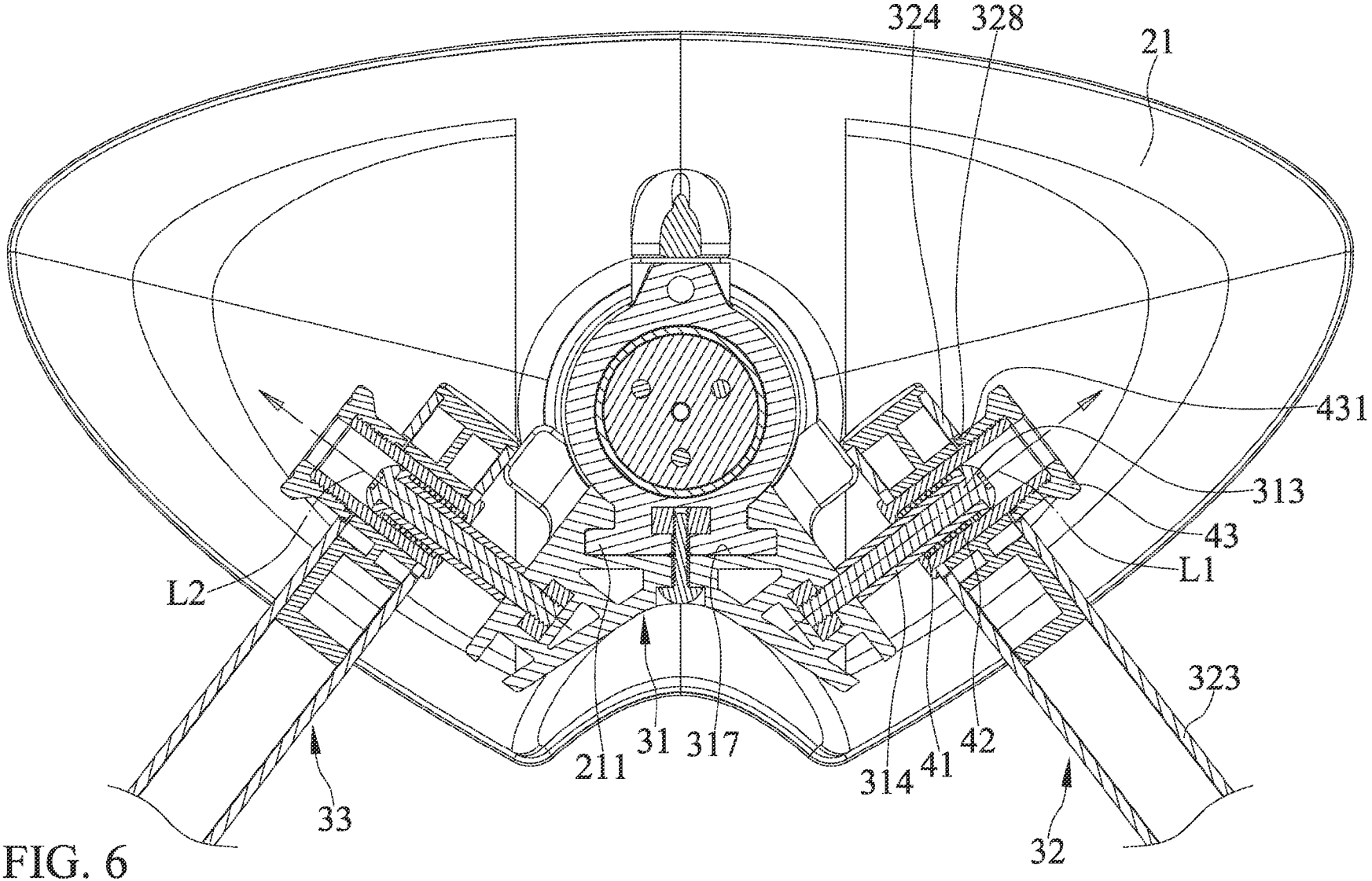
FIG. 6 is a continued view of FIG. 5 and shows the legs moved away from a base.
Figure 7:
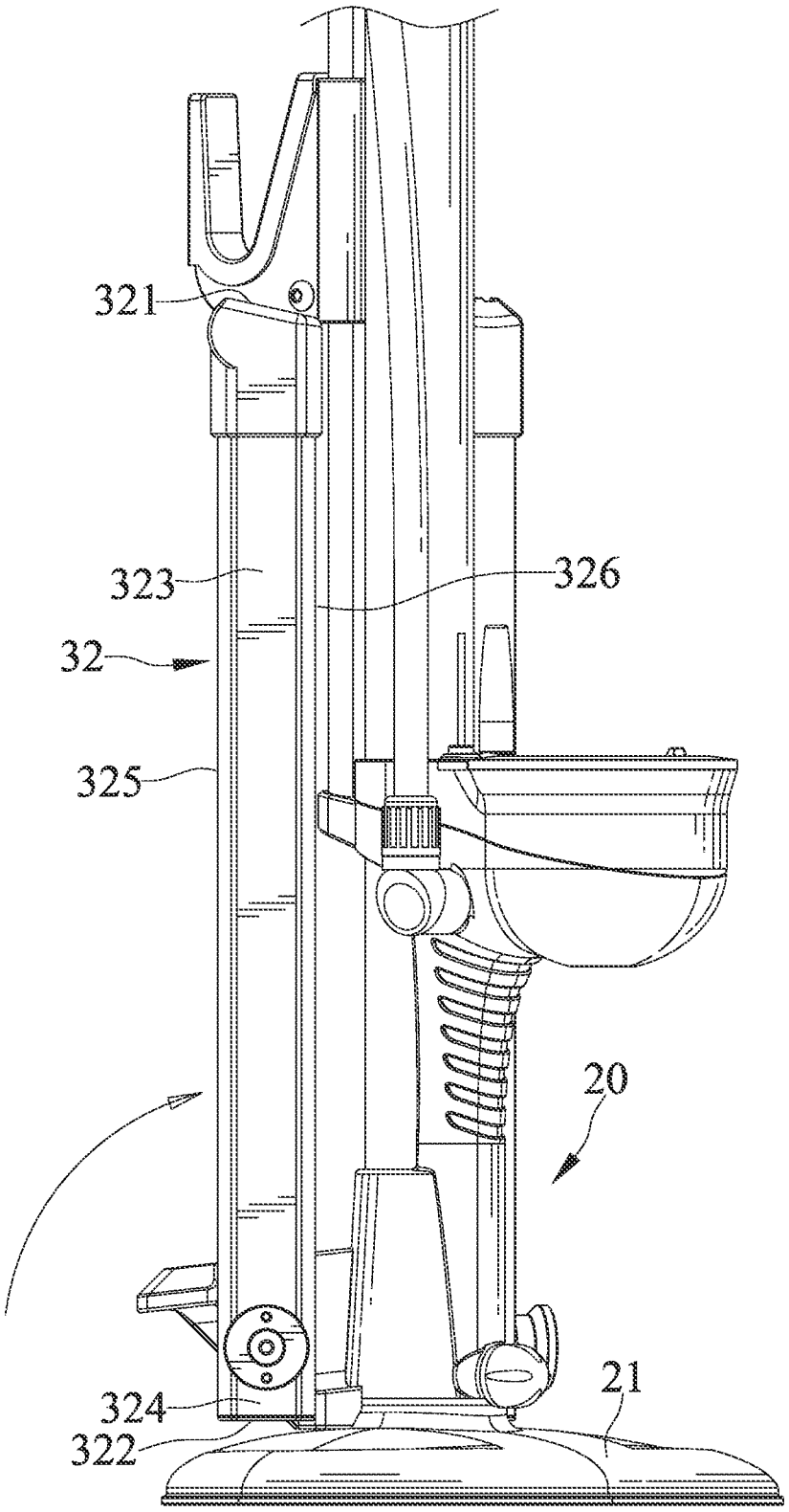
FIG. 7 is a side view of the floor pump of FIG. 1 and shows the legs arranged in a folded position.
Figure 8:
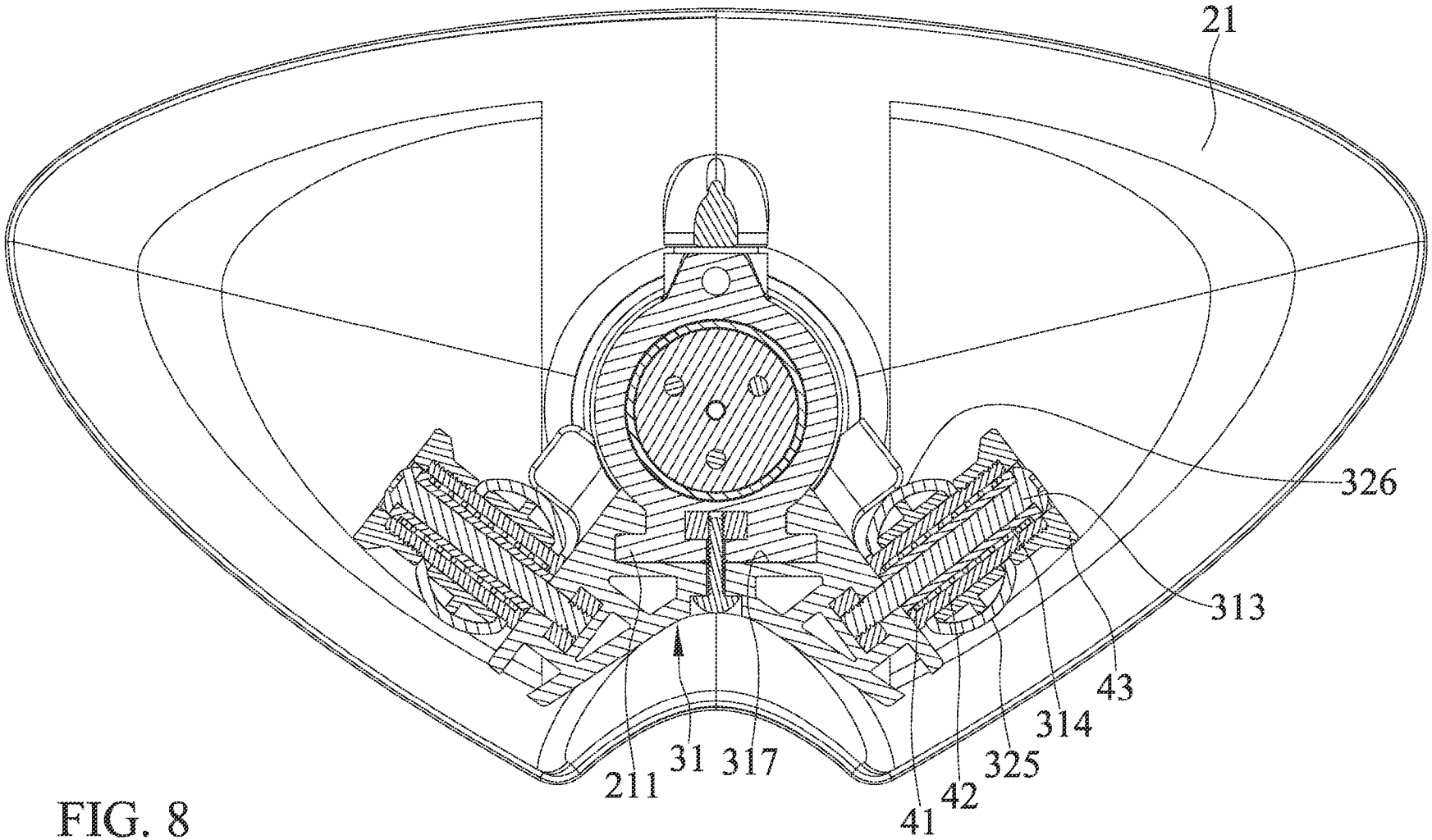
FIG. 8 is a cross sectional view of the floor pump of FIG. 7.
Figure 9:
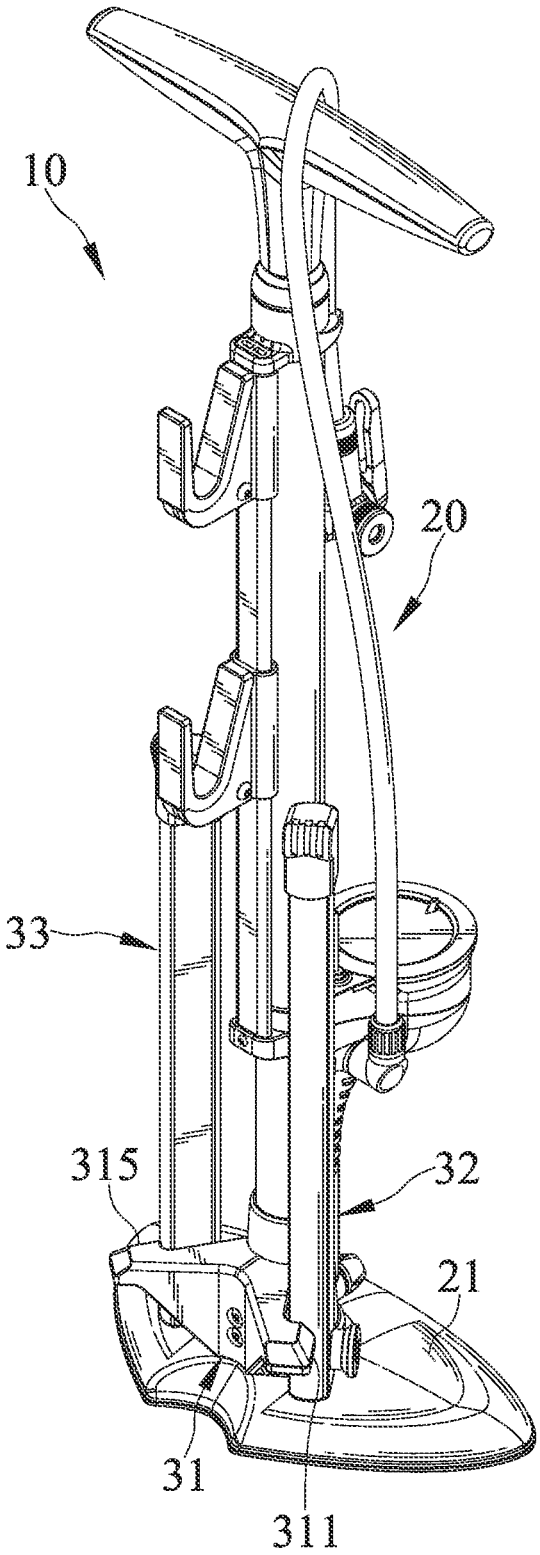
FIG. 9 is a perspective view of the floor pump of the first embodiment and shows legs arranged in the folded position.

FIGS. 1-9 show a floor pump 10 of a first embodiment according to the present invention. The floor pump 10 includes a main body 20 and a supporting device 30.

The supporting device 30 includes a base 31 and a first leg 32. The base 31 is fixed to the main body 20 and has a first stopping flange 311 and a second stopping flange 312. The first leg 32 is pivotally connected to the base 31 and rotatable relative to the base 31 about a first rotation axis L1. The first leg 32 is axially movable along the first rotation axis L1 to approach or move away from the base 31. The first leg 32 has a front end 321 and a rear end 322, and the first leg 32 forms a front section 323 between the front end 321 and the first rotation axis L1, and the first leg 32 forms a rear section 324 between the rear end 322 and the first rotation axis L1. The first leg 32 has a first side 325 and a second side 326 opposite to the first side 325 on an outer periphery thereof along a radial direction of the first rotation axis L1. When the first leg 32 is moved away from the base 31, the first leg 32 is rotatable relative to the base 31. When the first leg 32 is approached to the base 31, the first leg 32 is limited to a folded position or an unfolded position. When the first leg 32 is in the folded position, one side of the front section 323 adjacent to the first side 325 is close to the first stopping flange 311, and one side of the rear section 324 adjacent to the second side 326 is close to the second stopping flange 312, and the front end 321 is approached to the main body 20. When the first leg 32 is in the unfolded position, one side of the front section 323 adjacent to the second side 326 is close to the first stopping flange 311, and one side of the rear section 324 adjacent to the first side 325 is close to the second stopping flange 312, and the front end 321 is distal away from the main body 20.

The base 31 is connected to an axial rod 313 having an outer periphery sleeved by an axial sleeve 314. The first leg 32 has a pivot hole 327 along an axial direction of the first rotation axis L1. The floor pump 10 further includes a pivot mechanism 40, which includes a biasing member 41, a cover sleeve 42, and a pull collar 43. The biasing member 41 sleeves on the axial sleeve 314. The cover sleeve 42 inserts into the pivot hole 327 and sleeves on the biasing member 41. One end of the biasing member 41 along the axial direction of the first rotation axis L1 abuts against the axial sleeve 314 and another end of the biasing member 41 abuts against the cover sleeve 42. The pull collar 43 is connected to the cover sleeve 42 and located at one side of the first leg 32 opposite to the base 31.

The side of the first leg 32 opposite to the base 31 has an engaging recess 328 disposed adjacent to the pivot hole 327. One side of the pull collar 43 adjacent to the first leg 32 has an engaging flange 431 engaged with the engaging recess 328. The first leg 32 and the pull collar 43 is axially movable along the first rotation axis L1 synchronously. When the first leg 32 is moved away from the base 31, the first leg 32 and the pull collar 43 is rotatable relative to each other synchronously. The base 31 further has a third stopping flange 315 and a fourth stopping flange 316. The third stopping flange 315 and the first stopping flange 311 are respectively disposed on opposite sides of the base 31 and form a symmetrical structure. The fourth stopping flange 316 and the second stopping flange 312 are respectively disposed on opposite sides of the base 31 and form a symmetrical structure. The supporting device 30 further includes a second leg 33, which the is pivotally connected to the base 31 and rotatable relative to the base 31 about a second rotation axis L2. The second leg 33 is axially movable along the second rotation axis L2 to approach or move away from the base 31. When the second leg 33 is moved away from the base 31, the second leg 33 is rotatable relative to the base 31. When the second leg 33 is approached to the base 31, the second leg 33 is limited, and the second leg 33 and the first leg 32 are respectively arranged on two opposite sides of the base 31 and form a symmetrical structure.

The main body 20 has a footrest 21, which has a connection flange 211 extending in a vertical direction. An outer periphery of the connection flange 211 has a T-shaped cross section in a horizontal direction. The base 31 has a connection groove 317 and is movable in the vertical direction to cause the connection groove 317 to sleeve on the connection flange 211. An inner periphery of the connection groove 317 has a T-shaped cross section in the horizontal direction.

Thus, the floor pump 10 can provide stable and high-strength support when the legs 32 and 33 are in the unfolded position, and does not need to precisely align the concave-convex matching structure when folded, thereby improving the convenience of folding.

Figure 10:
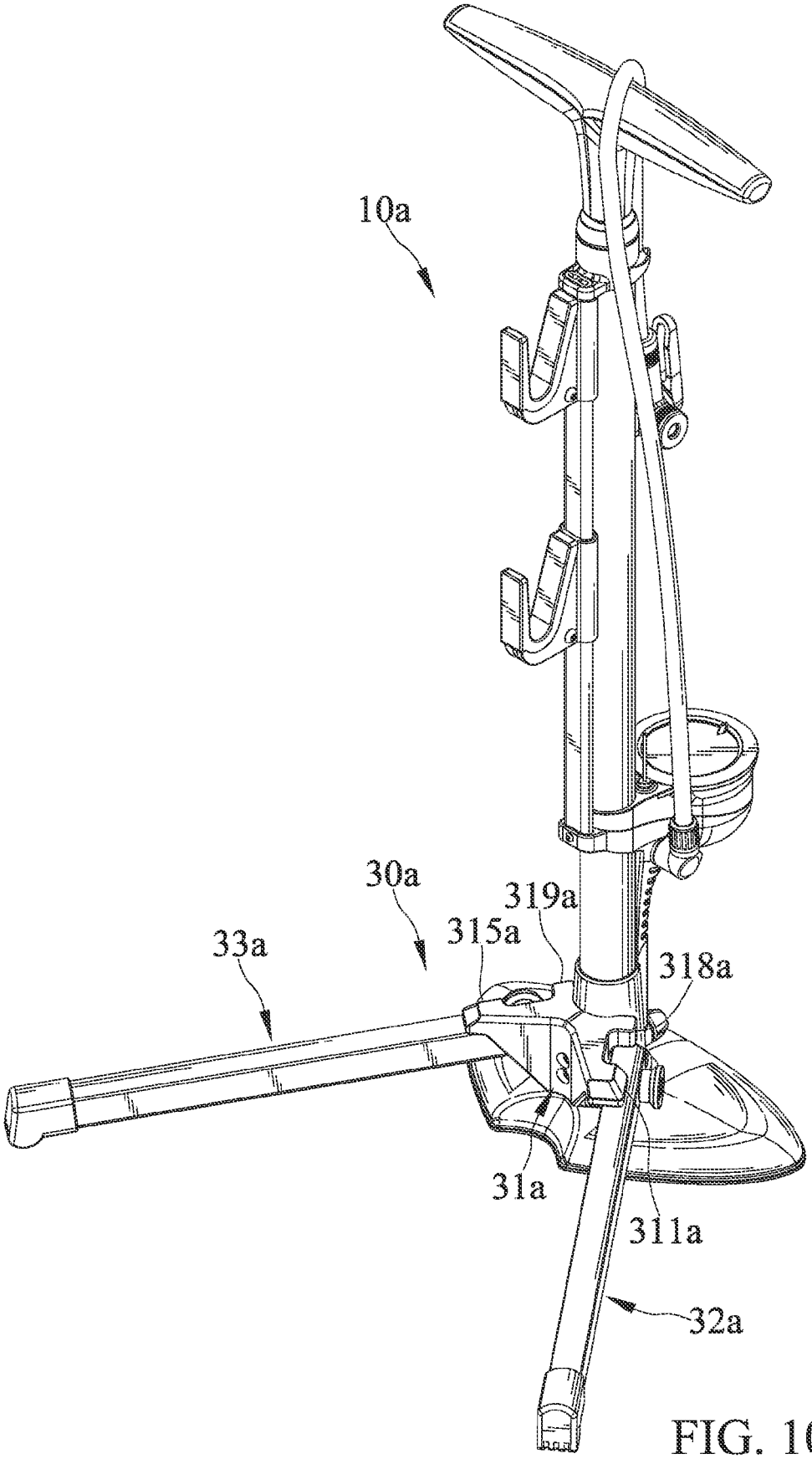
FIG. 10 is a perspective view of a floor pump of a second embodiment according to the present invention.
Figure 11:
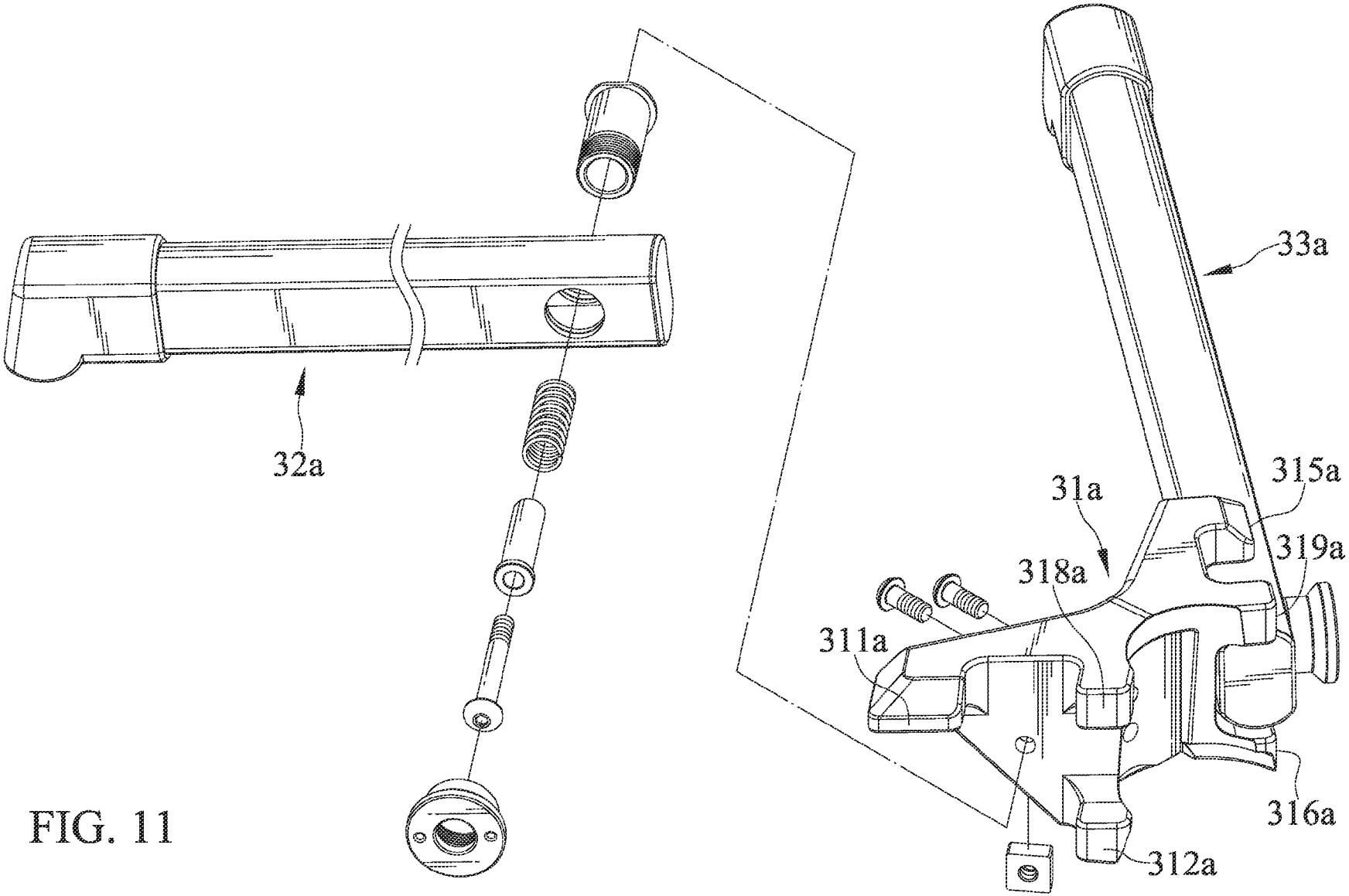
FIG. 11 is an exploded, perspective view of the floor pump of FIG. 10.
Figure 12:
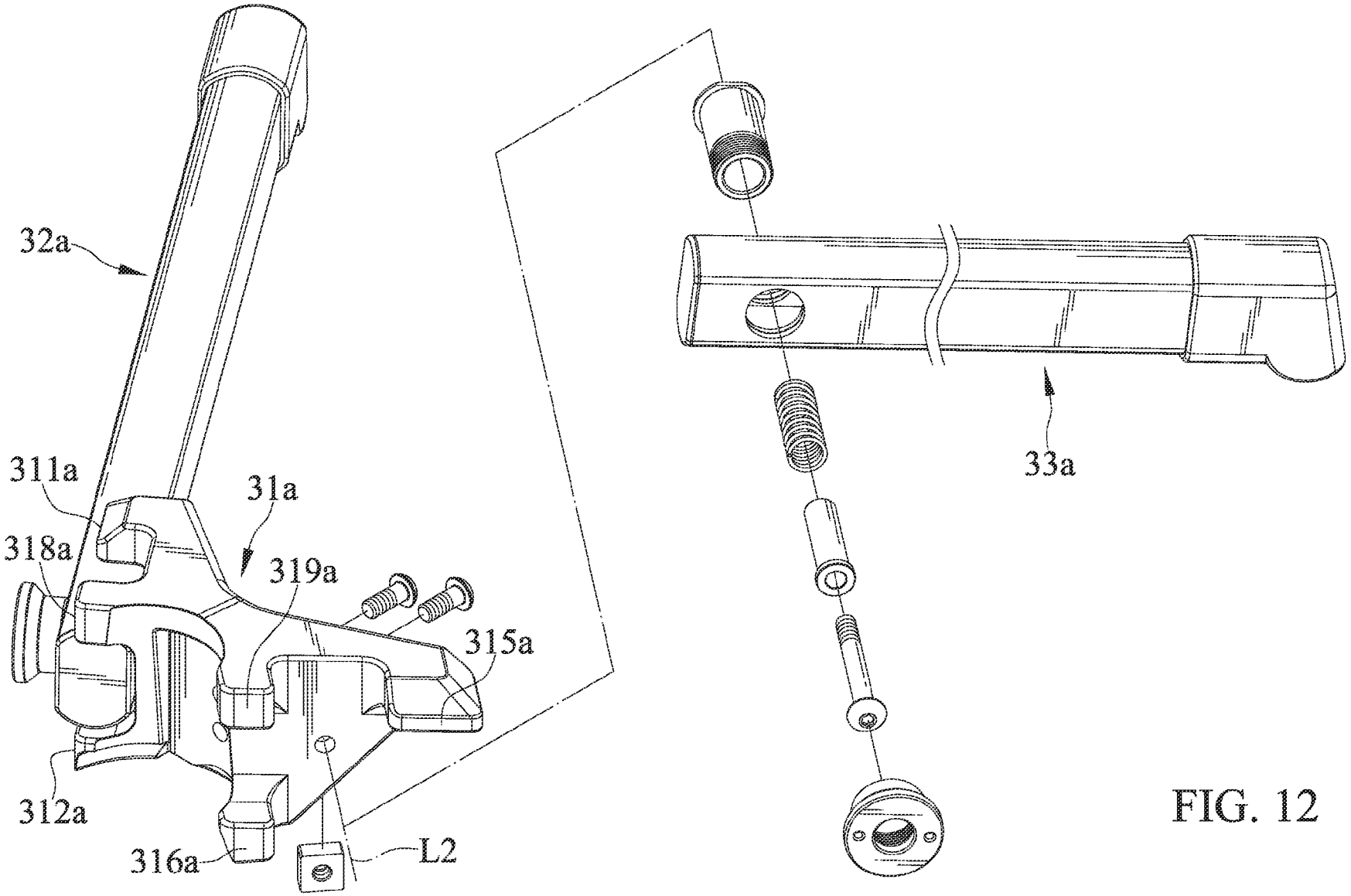
FIG. 12 is another exploded, perspective view of the floor pump of FIG. 10.
Figure 13:
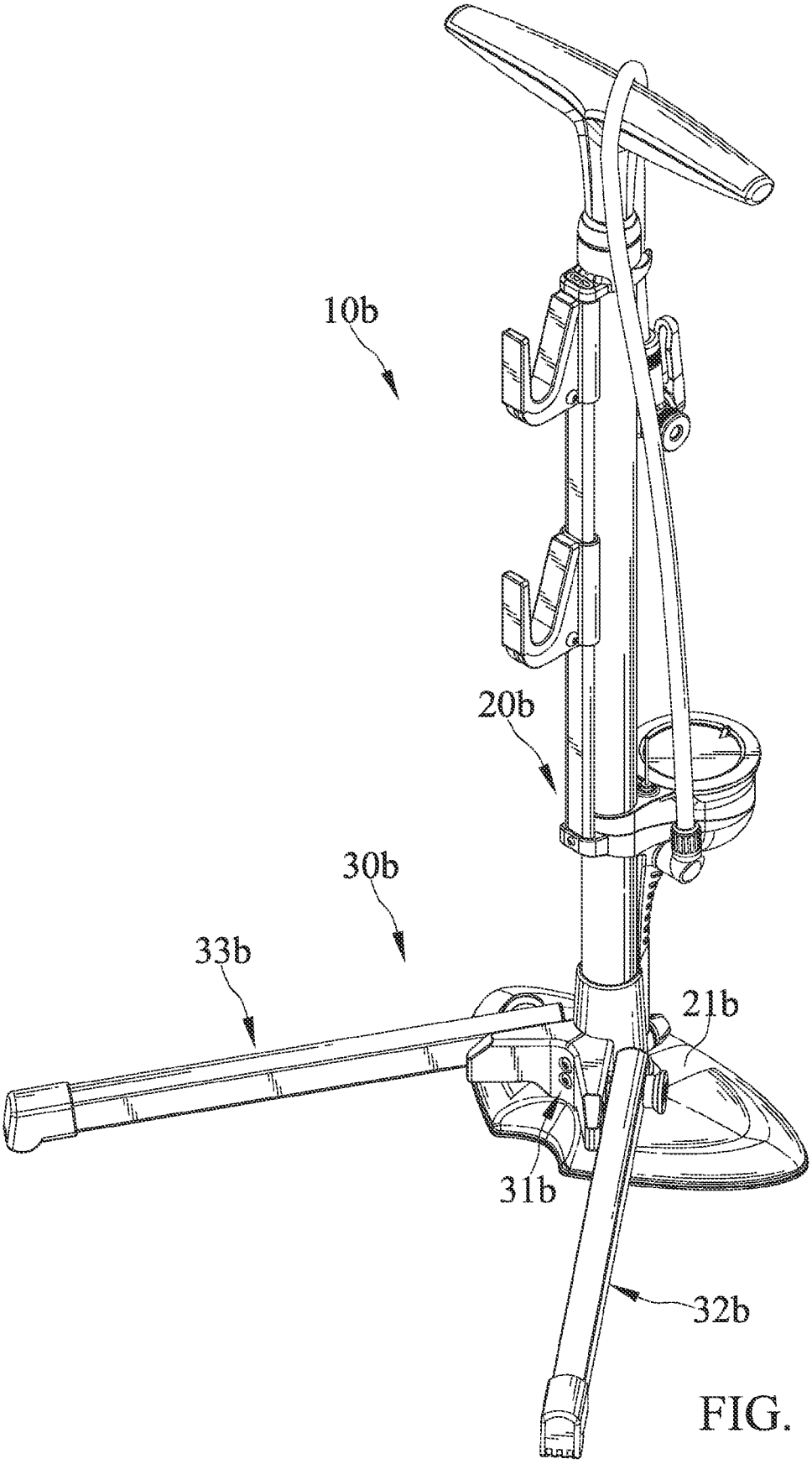
FIG. 13 is a perspective view of a floor pump of a third embodiment according to the present invention and shows legs arranged in an unfolded position.
Figure 14:
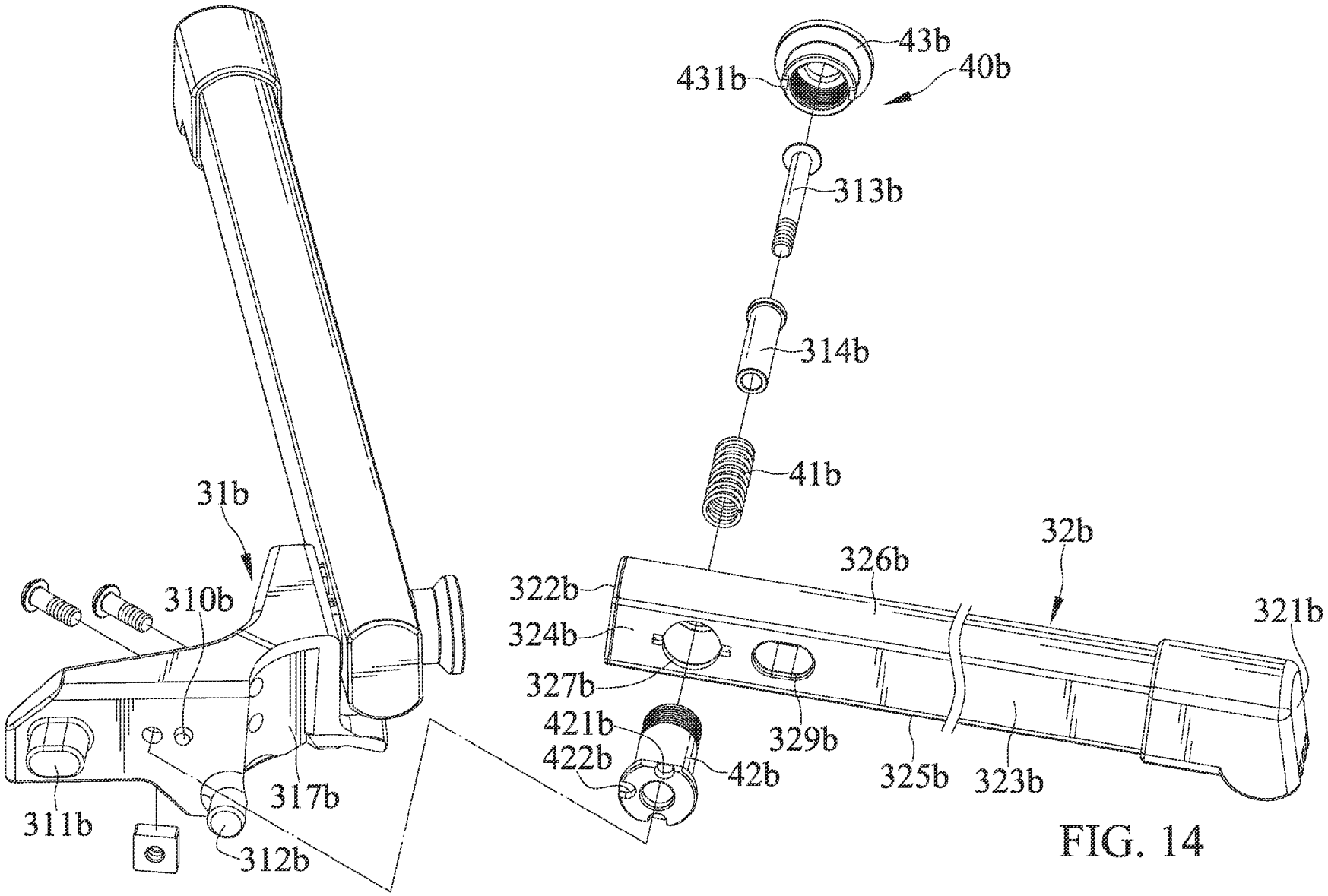
FIG. 14 is an exploded, perspective view of a supporting device of the floor pump of FIG. 13.
Figure 15:
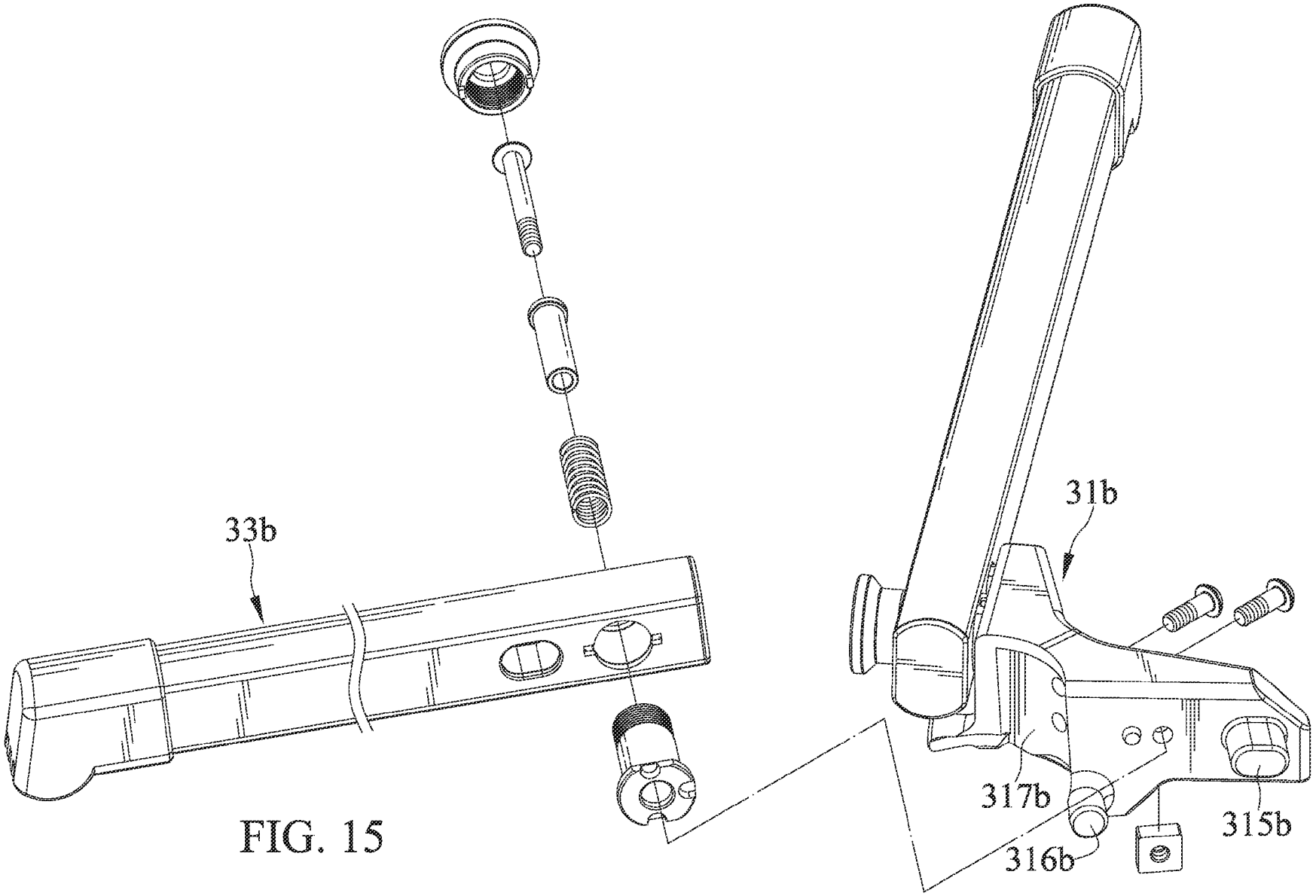
FIG. 15 is another exploded, perspective view of the supporting device of the floor pump of FIG. 13.
Figure 16:
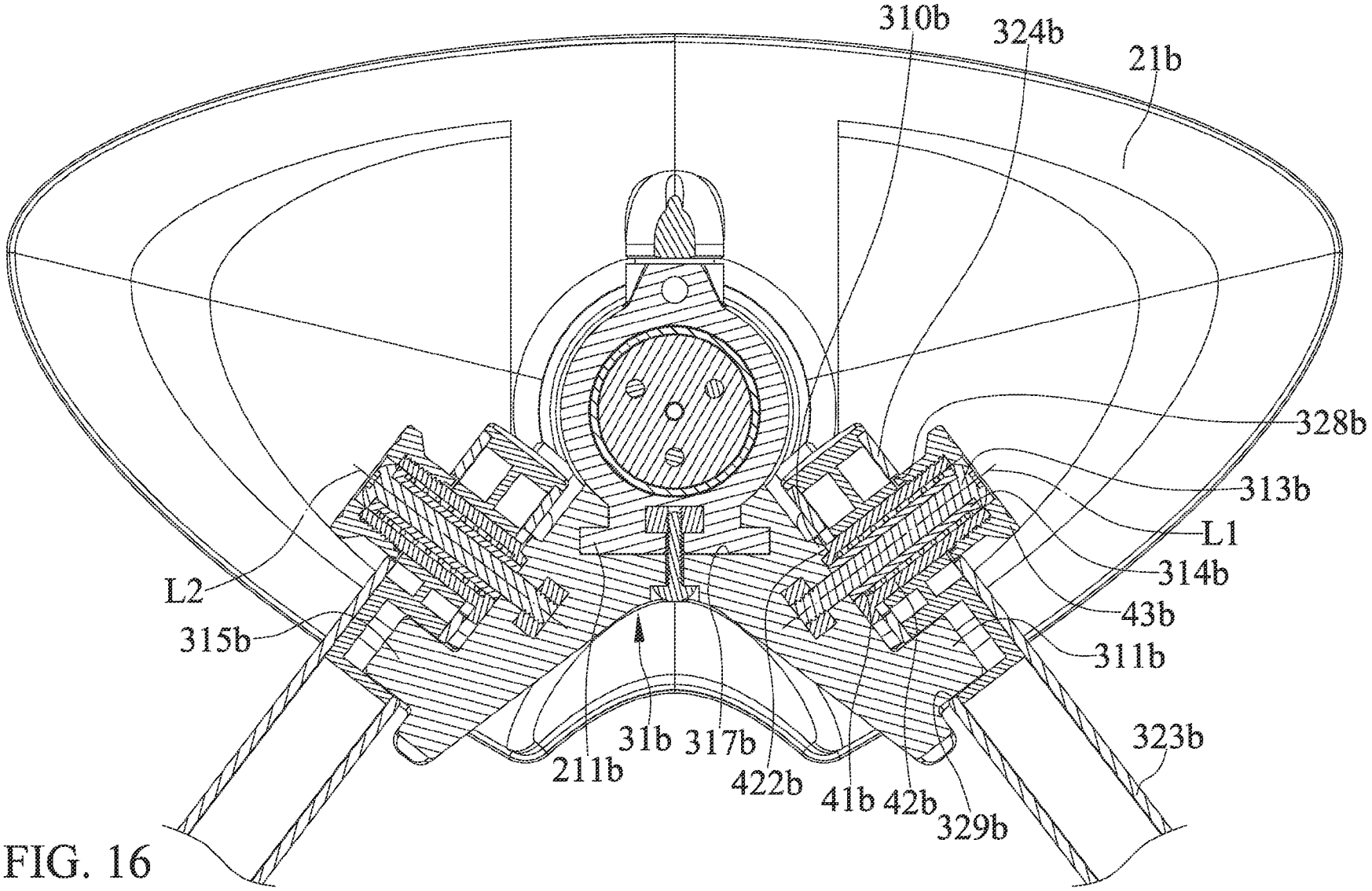
FIG. 16 is a cross sectional view of the floor pump of FIG. 13.
Figure 17:
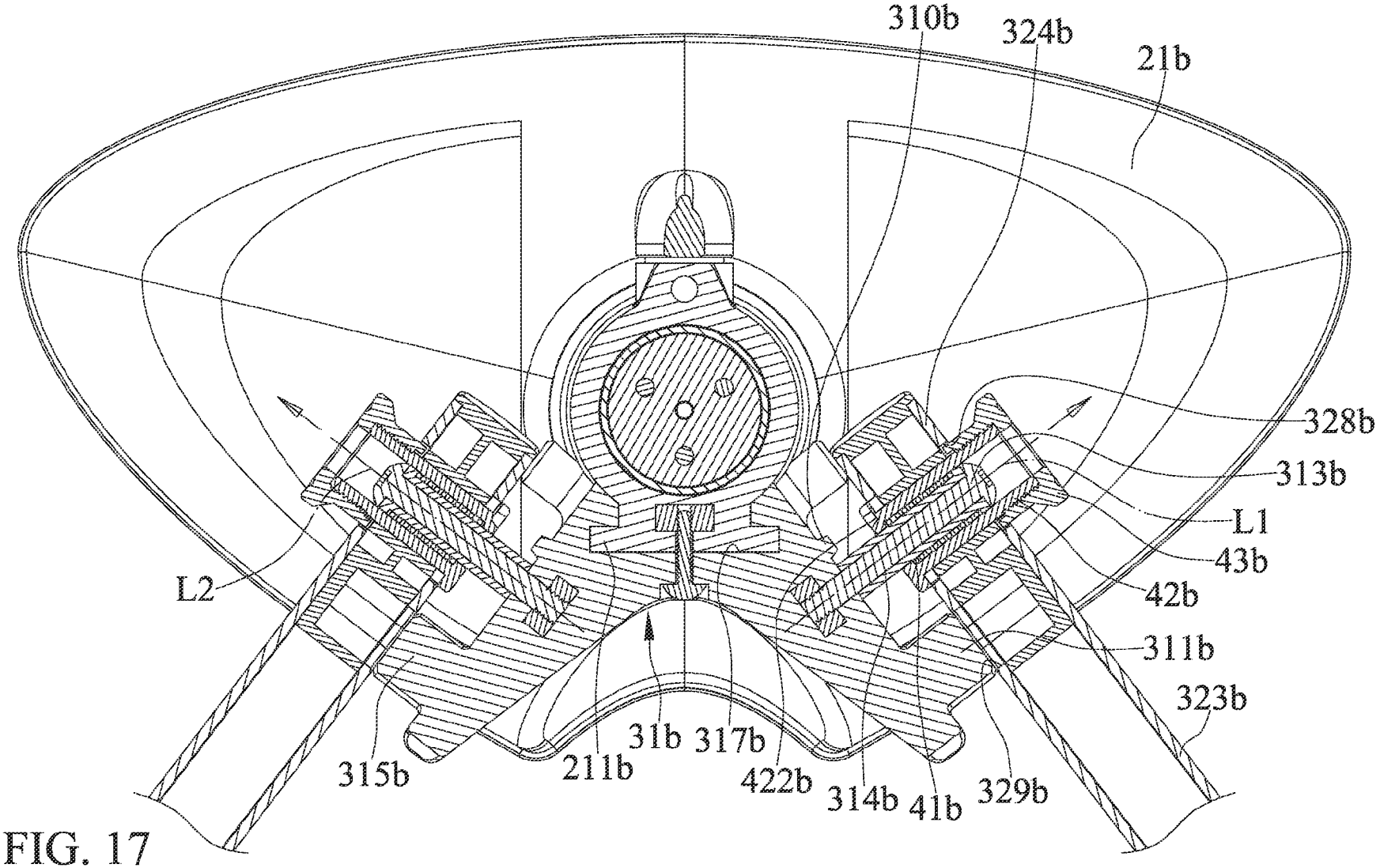
FIG. 17 is a continued view of FIG. 16 and shows the legs moved away from a base.
Figure 18:
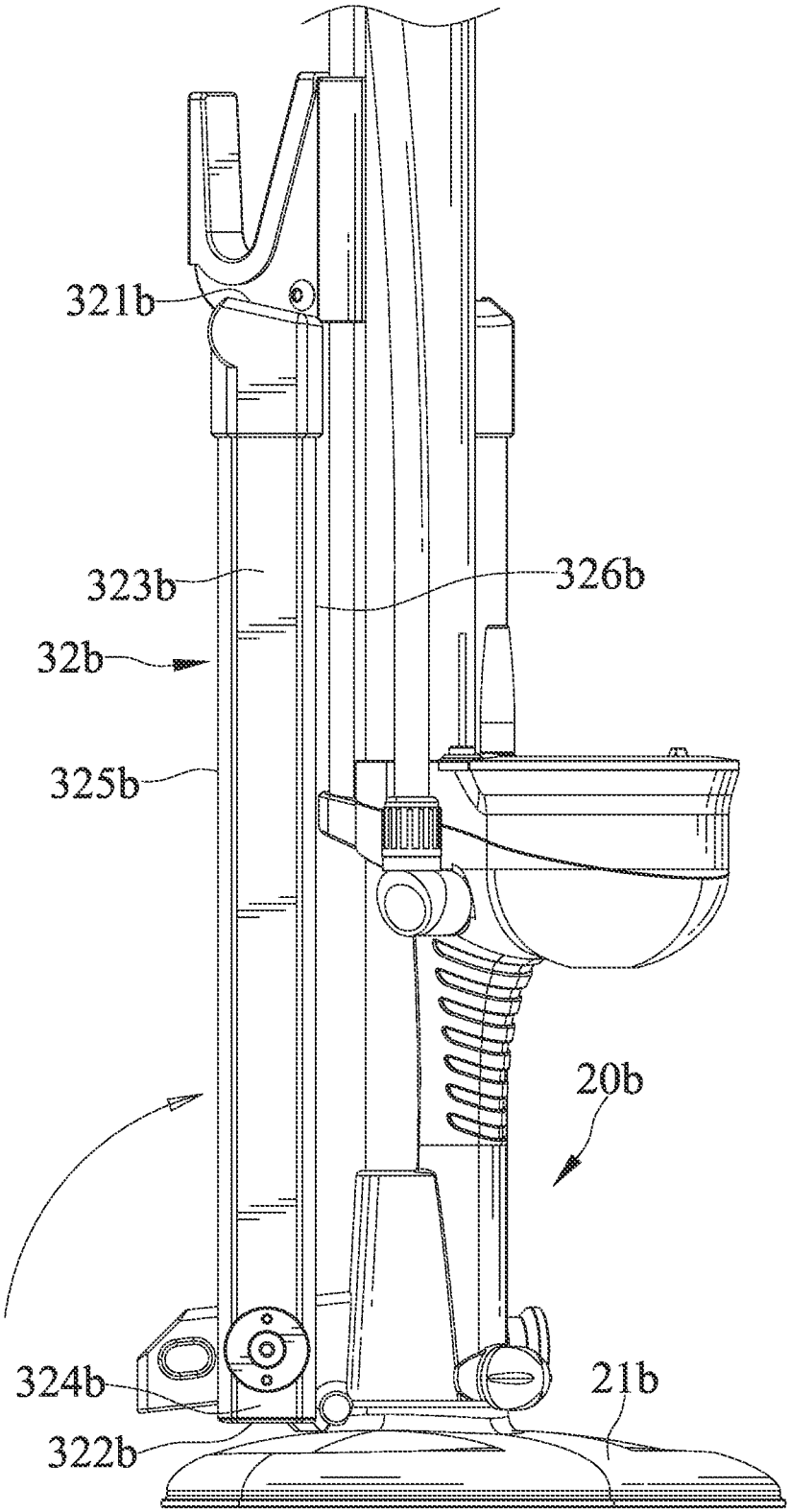
FIG. 18 is a side view of the floor pump of FIG. 13 and shows the legs arranged in a folded position.
Figure 19:
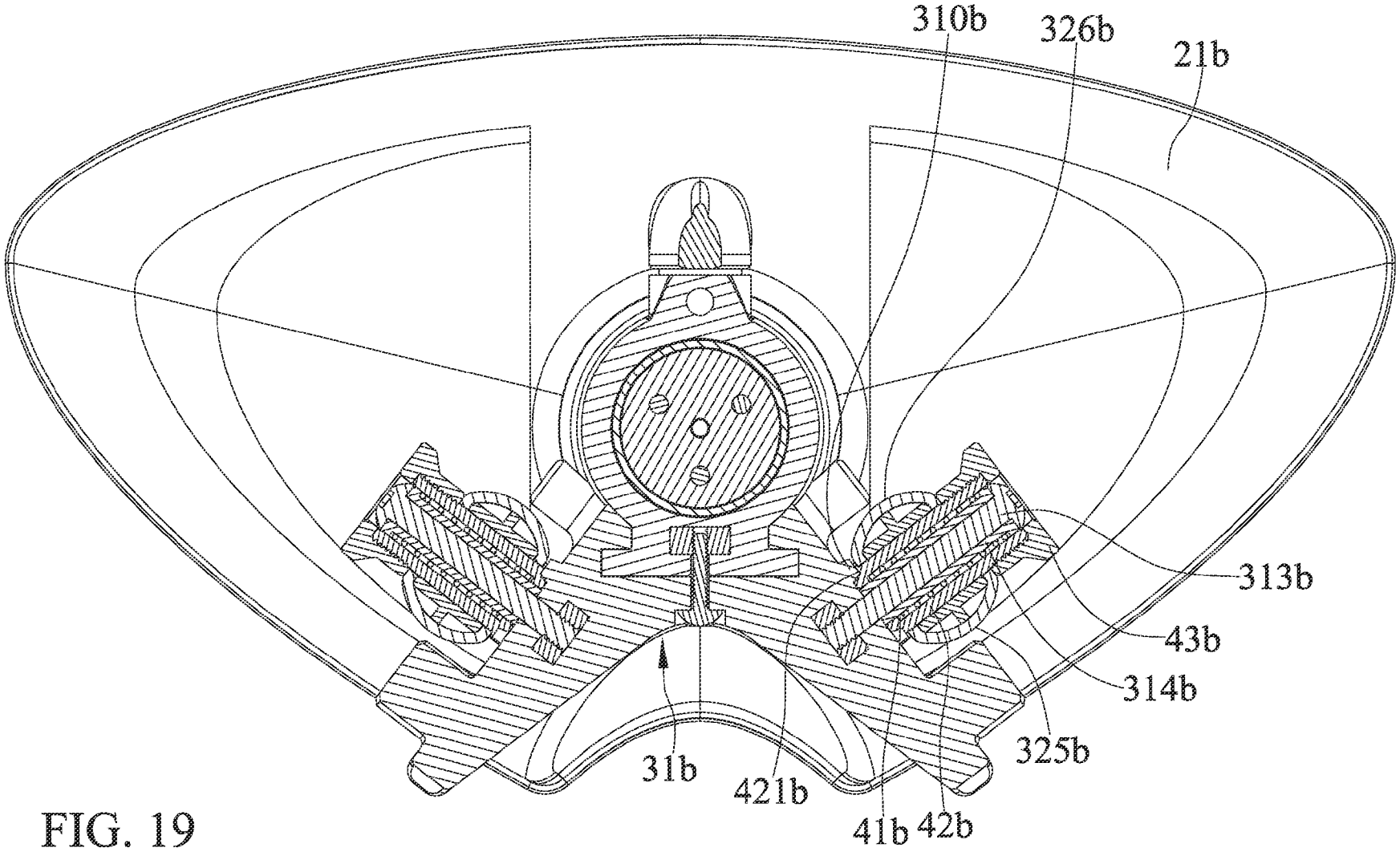
FIG. 19 is a cross sectional view of the floor pump of FIG. 18.
Figure 20:
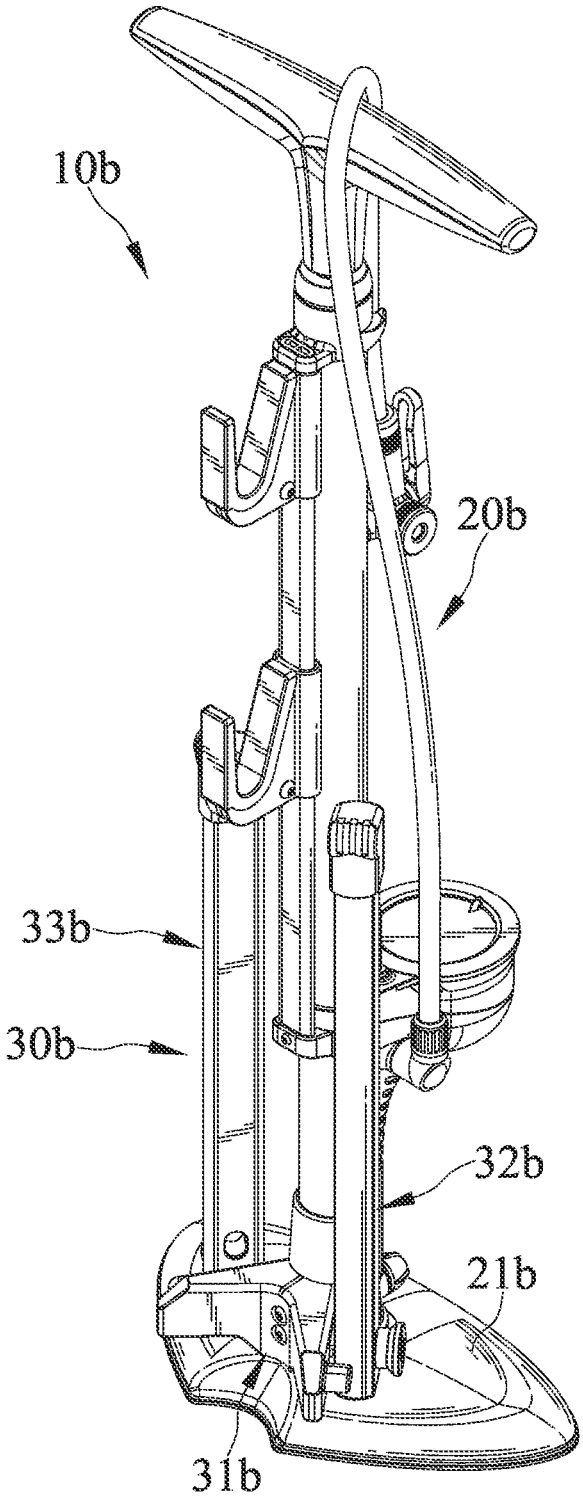
FIG. 20 is a perspective view of the floor pump of the third embodiment and shows legs arranged in the folded position.

FIGS. 10-12 show a floor pump 10*a* of a second embodiment according to the present invention. The second embedment is substantially the same as the first embodiment. The main differences are that the base 31*a* has a first limiting flange 318*a*. When the first leg 32*a* is in the folded position, the first leg 32*a* is limited between the first stopping flange 311*a* and the first limiting flange 318*a*. When the first leg 32*a* is in the unfolded position, the first leg 32*a* is limited between the first limiting flange 318*a* and the second stopping flange 312*a*.

The base 31*a* further has a third stopping flange 315*a*, a fourth stopping flange 316*a*, and a second limiting flange 319*a*. The third stopping flange 315*a* and the first stopping flange 311*a* are respectively arranged on two opposite sides of the base 31*a* and form a symmetrical structure.

The fourth stopping flange 316*a* and the second stopping flange 312*a* are respectively arranged on the two opposite sides of the base 31 a and form a symmetrical structure. The second limiting flange 319*a* and the first limiting flange 318*a* are respectively arranged on the two opposite sides of the base 31*a* and form a symmetrical structure. The supporting device 30*a* further includes a second leg 33*a*, which is pivotally connected to the base 31*a* and rotatable relative to the base 31*a* about a second rotation axis L2, and the second leg 33*a* is axially movable along the second rotation axis L2 to approach or move away from the base 31*a*. When the second leg 33*a* is moved away from the base 31*a*, the second leg 33*a* is rotatable relative to the base 31*a*. When the second leg 33*a* is approached to the base 31*a*, the second leg 33*a* is limited, and the second leg 33*a* and the first leg 32*a* are respectively arranged on the two opposite sides of the base 31*a* and form a symmetrical structure.

FIGS. 13-20 show a floor pump 10*b* of a third embodiment according to the present invention. The third embedment is substantially the same as the first embodiment. The main differences are that the floor pump 10*b* includes a main body 20*b* and a supporting device 30*b*.

The supporting device 30*b* including a base 31*b* and a first leg 32*b*. The base 31*b* is fixed to the main body 20*b* and has a first stopping flange 311*b* and a second stopping flange 312*b*. The first leg 32*b* is pivotally connected to the base 31*b* and rotatable relative to the base 31*b* about a first rotation axis L1, and the first leg 32*b* is axially movable along the first rotation axis L1 to approach or move away from the base 31*b*. The first leg 32*b* has a front end 321*b* and a rear end 322*b*. The first leg 32*b* forms a front section 323*b* between the front end 321*b* and the first rotation axis L1, and the first leg 32*b* forms a rear section 324*b* between the rear end 322*b* and the first rotation axis L1. The first leg 32*b* has a first side 325*b* and a second side 326*b* opposite to the first side 325*b* on an outer periphery thereof along a radial direction of the first rotation axis L1. One side of the first leg 32*b* adjacent to the base 31*b* has an engaging groove 329*b*. When the first leg 32*b* is moved away from the base 31*b*, the first leg 32*b* is rotatable relative to the base 31*b*. When the first leg 32*b* is approached to the base 31*b*, the first leg 32*b* is limited to a folded position or an unfolded position. When the first leg 32*b* is in the folded position, the first side 325*b* is close to the first stopping flange 311*b*, and one side of the rear section 324*b* adjacent to the second side 326*b* is close to the second stopping flange 312*b*, and the front end 321*b* is approached to the main body 20*b*. When the first leg 32*b* is in the unfolded position, the engaging groove 329*b* sleeves on the first stopping flange 311*b*, and one side of the rear section 324*b* adjacent to the first side 325*b* is close to the second stopping flange 312*b*, and the front end 321*b* is distal away from the main body 20*b*.

The base 31*b* is connected to an axial rod 313*b* having an outer periphery sleeved by an axial sleeve 314*b*. The first leg 32*b* has a pivot hole 327*b* along an axial direction of the first rotation axis L1. The floor pump 10*b* further includes a pivot mechanism 40*b*. The pivot mechanism 40*b* includes a biasing member 41*b*, a cover sleeve 42*b*, and a pull collar 43*b*. The biasing member 41*b* sleeves on the axial sleeve 314*b*. The cover sleeve 42*b* inserts into the pivot hole 327*b* and sleeves on the biasing member 41*b*. One end of the biasing member 41*b* along the axial direction of the first rotation axis L1 abuts against the axial sleeve 314*b* and another end of the biasing member 41*b* abuts against the cover sleeve 42*b*. The pull collar 43*b* is connected to the cover sleeve 42*b* and located at one side of the first leg 32*b* opposite to the base 31*b*.

The side of the first leg 32*b* opposite to the base 31*b* has an engaging recess 328*b* disposed adjacent to the pivot hole 327*b*. One side of the pull collar 43*b* adjacent to the first leg 32*b* has an engaging flange 431*b* engaged with the engaging recess 328*b*. The first leg 32*b* and the pull collar 43*b* is axially movable along the first rotation axis L1 synchronously. When the first leg 32*b* is moved away from the base 31*b*, the first leg 32*b* and the pull collar 43*b* is rotatable relative to each other synchronously.

The base 31*b* further has a positioning flange 310*b* disposed adjacent to the axial rod 313*b*. One side of the cover sleeve 42*b* adjacent to the base 31*b* has a first positioning recess 421*b* and a second positioning recess 422*b*. When the first leg 32*b* is in the folded position, the positioning flange 310*b* is engaged in the first positioning recess 421*b*. When the first leg 32*b* is in the unfolded position, the positioning flange 310*b* is engaged in the second positioning recess 422*b*.

The base 31*b* further has a third stopping flange 315*b* and a fourth stopping flange 316*b*. The third stopping flange 315*b* and the first stopping flange 311*b* are respectively arranged on two opposite sides of the base 31*b* and form a symmetrical structure. The fourth stopping flange 316*b* and the second stopping flange 312*b* are respectively arranged on the two opposite sides of the base 31*b* and form a symmetrical structure. The supporting device 30*b* further includes a second leg 33*b*. The second leg 33*b* is pivotally connected to the base 31*b* and rotatable relative to the base 31*b* about a second rotation axis L2, and the second leg 33*b* is axially movable along the second rotation axis L2 to approach or move away from the base 31*b*. When the second leg 33*b* is moved away from the base 31*b*, the second leg 33*b* is rotatable relative to the base 31*b*. When the second leg 33*b* is approached to the base 31*b*, the second leg 33*b* is limited, and the second leg 33*b* and the first leg 32*b* are respectively arranged on the two opposite sides of the base 31*b* and form a symmetrical structure.

The main body 20*b* has a footrest 21*b*. The footrest 21*b* has a connection flange 211*b* extending in a vertical direction. An outer periphery of the connection flange 211*b* has a T-shaped cross section in a horizontal direction. The base 31*b* has a connection groove 317*b* and is movable in the vertical direction to cause the connection groove 317*b* to sleeve on the connection flange 211*b*. An inner periphery of the connection groove 317*b* has a T-shaped cross section in the horizontal direction.

Although specific embodiments have been illustrated and described, numerous modifications and variations are still possible without departing from the scope of the invention. The scope of the invention is limited by the accompanying claims.

The invention claimed is:

1. A floor pump comprising:

a main body; and a supporting device including a base and a first leg, wherein the base is fixed to the main body and has a first stopping flange and a second stopping flange, wherein the first leg is pivotally connected to the base and rotatable relative to the base about a first rotation axis, and the first leg is axially movable along the first rotation axis to approach or move away from the base, wherein the first leg has a front end and a rear end, wherein the first leg forms a front section between the front end and the first rotation axis, and the first leg forms a rear section between the rear end and the first rotation axis, wherein the first leg has a first side and a second side opposite to the first side on an outer periphery thereof along a radial direction of the first rotation axis;

wherein when the first leg is moved away from the base, the first leg is rotatable relative to the base, and when the first leg is approached to the base, the first leg is limited to a folded position or an unfolded position;

wherein when the first leg is in the folded position, one side of the front section adjacent to the first side is close to the first stopping flange, and one side of the rear section adjacent to the second side is close to the second stopping flange, and the front end is approached to the main body;

wherein when the first leg is in the unfolded position, one side of the front section adjacent to the second side is close to the first stopping flange, and one side of the rear section adjacent to the first side is close to the second stopping flange, and the front end is distal away from the main body.

2. The floor pump as claimed in claim 1, wherein the base is connected to an axial rod having an outer periphery sleeved by an axial sleeve, wherein the first leg has a pivot hole along an axial direction of the first rotation axis, wherein the floor pump further includes a pivot mechanism, wherein the pivot mechanism includes a biasing member, a cover sleeve, and a pull collar, wherein the biasing member sleeves on the axial sleeve, wherein the cover sleeve inserts into the pivot hole and sleeves on the biasing member, wherein one end of the biasing member along the axial direction of the first rotation axis abuts against the axial sleeve and another end of the biasing member abuts against the cover sleeve, and wherein the pull collar is connected to the cover sleeve and located at one side of the first leg opposite to the base.

3. The floor pump as claimed in claim 2, wherein the side of the first leg opposite to the base has an engaging recess disposed adjacent to the pivot hole, wherein one side of the pull collar adjacent to the first leg has an engaging flange engaged with the engaging recess, wherein the first leg and the pull collar is axially movable along the first rotation axis synchronously, and when the first leg is moved away from the base, the first leg and the pull collar is rotatable relative to each other synchronously.

4. The floor pump as claimed in claim 3, wherein the base further has a third stopping flange and a fourth stopping flange, wherein the third stopping flange and the first stopping flange are respectively disposed on opposite sides of the base and form a symmetrical structure, wherein the fourth stopping flange and the second stopping flange are respectively disposed on opposite sides of the base and form a symmetrical structure, wherein the supporting device further includes a second leg, wherein the second leg is pivotally connected to the base and rotatable relative to the base about a second rotation axis, and the second leg is axially movable along the second rotation axis to approach or move away from the base, wherein when the second leg is moved away from the base, the second leg is rotatable relative to the base, and when the second leg is approached to the base, the second leg is limited, and the second leg and the first leg are respectively arranged on two opposite sides of the base and form a symmetrical structure.

5. The floor pump as claimed in claim 3, wherein the base has a first limiting flange, wherein when the first leg is in the folded position, the first leg is limited between the first stopping flange and the first limiting flange, wherein when the first leg is in the unfolded position, the first leg is limited between the first limiting flange and the second stopping flange.

6. The floor pump as claimed in claim 5, wherein the base further has a third stopping flange, a fourth stopping flange, and a second limiting flange, wherein the third stopping flange and the first stopping flange are respectively arranged on two opposite sides of the base and form a symmetrical structure, wherein the fourth stopping flange and the second stopping flange are respectively arranged on the two opposite sides of the base and form a symmetrical structure, wherein the second limiting flange and the first limiting flange are respectively arranged on the two opposite sides of the base and form a symmetrical structure, wherein the supporting device further includes a second leg, wherein the second leg is pivotally connected to the base and rotatable relative to the base about a second rotation axis, and the second leg is axially movable along the second rotation axis to approach or move away from the base, wherein when the second leg is moved away from the base, the second leg is rotatable relative to the base, and when the second leg is approached to the base, the second leg is limited, and the second leg and the first leg are respectively arranged on the two opposite sides of the base and form a symmetrical structure.

7. The floor pump as claimed in claim 1, wherein the main body has a footrest, wherein the footrest has a connection flange extending in a vertical direction, wherein an outer periphery of the connection flange has a T-shaped cross section in a horizontal direction, wherein the base has a connection groove and is movable in the vertical direction to cause the connection groove to sleeve on the connection flange, and wherein an inner periphery of the connection groove has a T-shaped cross section in the horizontal direction.

8. A floor pump comprising:

a main body; and a supporting device including a base and a first leg, wherein the base is fixed to the main body and has a first stopping flange and a second stopping flange, wherein the first leg is pivotally connected to the base and rotatable relative to the base about a first rotation axis, and the first leg is axially movable along the first rotation axis to approach or move away from the base, wherein the first leg has a front end and a rear end, wherein the first leg forms a front section between the front end and the first rotation axis, and the first leg forms a rear section between the rear end and the first rotation axis, wherein the first leg has a first side and a second side opposite to the first side on an outer periphery thereof along a radial direction of the first rotation axis, and wherein one side of the first leg adjacent to the base has an engaging groove;

wherein when the first leg is moved away from the base, the first leg is rotatable relative to the base, and when the first leg is approached to the base, the first leg is limited to a folded position or an unfolded position;

wherein when the first leg is in the folded position, the first side is close to the first stopping flange, and one side of the rear section adjacent to the second side is close to the second stopping flange, and the front end is approached to the main body;

wherein when the first leg is in the unfolded position, the engaging groove sleeves on the first stopping flange, and one side of the rear section adjacent to the first side is close to the second stopping flange, and the front end is distal away from the main body.

9. The floor pump as claimed in claim 8, wherein the base is connected to an axial rod having an outer periphery sleeved by an axial sleeve, wherein the first leg has a pivot hole along an axial direction of the first rotation axis, wherein the floor pump further includes a pivot mechanism, wherein the pivot mechanism includes a biasing member, a cover sleeve, and a pull collar, wherein the biasing member sleeves on the axial sleeve, wherein the cover sleeve inserts into the pivot hole and sleeves on the biasing member, wherein one end of the biasing member along the axial direction of the first rotation axis abuts against the axial sleeve and another end of the biasing member abuts against the cover sleeve, and wherein the pull collar is connected to the cover sleeve and located at one side of the first leg opposite to the base.

10. The floor pump as claimed in claim 9, wherein the side of the first leg opposite to the base has an engaging recess disposed adjacent to the pivot hole, wherein one side of the pull collar adjacent to the first leg has an engaging flange engaged with the engaging recess, wherein the first leg and the pull collar is axially movable along the first rotation axis synchronously, and when the first leg is moved away from the base, the first leg and the pull collar is rotatable relative to each other synchronously.

11. The floor pump as claimed in claim 10, wherein the base further has a positioning flange disposed adjacent to the axial rod, wherein one side of the cover sleeve adjacent to the base has a first positioning recess and a second positioning recess, wherein when the first leg is in the folded position, the positioning flange is engaged in the first positioning recess, and wherein when the first leg is in the unfolded position, the positioning flange is engaged in the second positioning recess.

12. The floor pump as claimed in claim 11, wherein the base further has a third stopping flange and a fourth stopping flange, wherein the third stopping flange and the first stopping flange are respectively arranged on two opposite sides of the base and form a symmetrical structure, wherein the fourth stopping flange and the second stopping flange are respectively arranged on the two opposite sides of the base and form a symmetrical structure, wherein the supporting device further includes a second leg, wherein the second leg is pivotally connected to the base and rotatable relative to the base about a second rotation axis, and the second leg is axially movable along the second rotation axis to approach or move away from the base, wherein when the second leg is moved away from the base, the second leg is rotatable relative to the base, and when the second leg is approached to the base, the second leg is limited, and the second leg and the first leg are respectively arranged on the two opposite sides of the base and form a symmetrical structure.

13. The floor pump as claimed in claim 8, wherein the main body has a footrest, wherein the footrest has a connection flange extending in a vertical direction, wherein an outer periphery of the connection flange has a T-shaped cross section in a horizontal direction, wherein the base has a connection groove and is movable in the vertical direction to cause the connection groove to sleeve on the connection flange, and wherein an inner periphery of the connection groove has a T-shaped cross section in the horizontal direction.

* * * * *